US009508482B2

(12) United States Patent
Suzuki

(10) Patent No.: US 9,508,482 B2
(45) Date of Patent: Nov. 29, 2016

(54) REACTOR

(71) Applicant: TAMURA CORPORATION, Tokyo (JP)

(72) Inventor: Kotaro Suzuki, Saitama (JP)

(73) Assignee: TAMURA CORPORATION (JP)

( * ) Notice: Subject to any disclaimer, the term of this patent is extended or adjusted under 35 U.S.C. 154(b) by 91 days.

(21) Appl. No.: 14/535,184

(22) Filed: Nov. 6, 2014

(65) Prior Publication Data

US 2015/0130576 A1 May 14, 2015

(30) Foreign Application Priority Data

Nov. 12, 2013 (JP) ..... 2013-234290

(51) Int. Cl.

| | |
|---|---|
| ***H01F 27/00*** | (2006.01) |
| ***H01F 27/26*** | (2006.01) |
| ***H01F 27/02*** | (2006.01) |
| ***H01F 41/00*** | (2006.01) |

(52) U.S. Cl.

CPC ..... *H01F 27/266* (2013.01); *H01F 27/00* (2013.01); *H01F 27/022* (2013.01); *H01F 41/005* (2013.01); *Y10T 29/49071* (2015.01)

(58) Field of Classification Search

CPC ..... H01F 27/00–27/30
USPC ..... 336/65, 90, 96, 192, 196–198, 336/210–212, 220–223

See application file for complete search history.

(56) References Cited

U.S. PATENT DOCUMENTS

| | | | | |
|---|---|---|---|---|
| 9,147,516 | B2 * | 9/2015 | Suzuki | H01F 27/263 |
| 2009/0108971 | A1 * | 4/2009 | Okamoto | H01F 37/00 336/65 |
| 2015/0035636 | A1 * | 2/2015 | Nakatsu | H01F 27/263 336/192 |

FOREIGN PATENT DOCUMENTS

| | | |
|---|---|---|
| JP | 2013098346 | 5/2013 |
| JP | 2013197567 | 9/2013 |

* cited by examiner

*Primary Examiner* — Tuyen Nguyen

(57) ABSTRACT

U-shaped cores and fasteners are embedded in resin members, and brackets provided at respective ends of the fasteners protrude from the resin members. By fixing the brackets and a casing with screws, a reactor main body and the casing are fixed together. Openings formed by a partition wall that suppresses a direct application of a resin flowing from resin-filling portions to the fasteners are provided between the respective fasteners and the respective resin-filling portions. A protrusion extending in an opposite direction to a core and in parallel with the partition wall is provided between the resin-filling portions and the partition wall. The resin flowing from the resin-filling portion flows in between a core upper face and the fastener, and between a fastener surface located behind the partition wall and the internal surface of a die.

8 Claims, 6 Drawing Sheets

REACTOR

CROSS-REFERENCE TO RELATED APPLICATIONS

This application is based upon and claims the benefit of priority from Japanese Patent Application NO. 2013-234290, filed on Nov. 12, 2013; the entire contents of which are incorporated herein by reference.

TECHNICAL FIELD

The disclosure of the present application relates to a reactor having an improved resin-mold structure for a fastener.

BACKGROUND ART

As disclosed in, for example, JP 2013-197567 A and JP 2013-098346 A, a reactor applied to an in-vehicle booster circuit has a coil wound around a resin-made bobbin disposed around a core. Those components are retained in a metal casing, and a sealing resin is filled in the casing to secure those components.

For example, a conventional technology illustrated in FIG. 6 is disclosed in JP 2013-197567 A that has divisional cores and a resin member covering therearound. In FIG. 6, 100 indicates right and left leg portions of an annular core, 101 indicates yokes of the annular core, and 102 indicates resin members having the respective yokes 101 embedded therein by molding. The resin member 102 is continuously provided with cylindrical bobbins 102*a*, and I-shaped cores forming the leg portion 100 are inserted into each bobbin 102*a*, and a coil 103 is wound around the bobbin 102*a*.

This type of reactor is retained in a metal casing 104 formed of aluminum or the like which has an excellent heat dissipation performance, and is fixed to a vehicle or other devices. In this case, a sealing resin is filled between the reactor and the casing 104 to ensure the fastening of the reactor in the casing 104 and to ensure the electrical insulation. In addition, when the reactor is fixed to the casing 104, it is typical that fasteners 105 are embedded integrally in the resin member 102 by molding, and the fasteners 105 are fixed to the casing 104 by screws.

According to this type of reactor, for embedding the fastener 105 in the resin member 102 by molding, injection molding is used. That is, the fastener 105 is disposed in a die, a resin is filled around the fastener 105 through a resin-filling aperture provided in the die, and then the filled resin is cured. However, since the injection pressure of the resin is quite high, the flowing resin may directly contact the fastener. As a result the fastener may be mis-positioned in the die or the center part of the die may be dented.

In particular, for fixing both sides of the reactor main body by only one fastener, the fastener 105 illustrated in the enlarged view of FIG. 7 is made as a long and thin tabular member. Therefore, the center of the fastener is dented in an arc shape, and the tips of respective screwing brackets 105*a* that are formed at both ends of the fastener are lifted up from the horizontal level. The lifting of the brackets 105*a* might be addressed by fixing those pieces to the casing 104 with screws, but actually, the basal end of the bracket 105*a* is deformed because of large load by screwing, and intensive stress is always applied thereto.

This type of reactor is utilized in various applications, but in recent years, such a reactor is placed in a location where vibrations are applied for a long time like over 10 years, such as the in-vehicle application. Hence, when vibrations are applied to the basal end of the bracket 105*a* to which stress is already applied as explained above for a long time, the fastener 105 may break from the basal end of the bracket 105*a*.

The present disclosure has been proposed to address the aforementioned technical problems of conventional technologies, and it is an objective of the present disclosure to suppress direct application of injection pressure of a resin to the fastener at the time of molding, and thereby providing a reactor that has little deformation of a fastener and that can prevent the fastener from being broken down even if vibration is applied thereto for a long time.

SUMMARY

To accomplish the objective, a reactor of the present disclosure comprises:

(1) a reactor main body, a casing retaining thereinside the reactor main body, and a fastener fixing the reactor main body to the casing;

(2) the reactor main body includes a core, a resin member covering around the core, a coil wound around the resin member;

(3) the fastener includes a portion embedded in the resin member, and a bracket protruding from the resin member, the bracket being fixed to the casing; and (4) the resin member is provided with an opening exposing a surface of the portion of the fastener embedded in the resin member.

In one aspect, the opening may be formed by, when the resin member is molded using a die, a partition wall provided in the die, and the partition wall may suppress a direct application of a pressure of a resin to be filled in the die to the fastener.

The fastener may be a long and thin tabular member and have the bracket that protrudes from the resin member at each end of the tabular member, and the fastener may be disposed in parallel with a surface of the core with a predetermined space present therebetween, and a part of the resin member may be filled in the predetermined space.

In one aspect, the partition wall abuts the surface of the fastener from the opposite side to the core, and prevents the fastener from being deformed by the injection pressure of the resin flowing in between the core surface and the fastener. Hence, it is preferable that the opening formed in the resin member should have a depth reaching the surface of the fastener from the surface of the resin member at a location facing with the core surface.

In one aspect, it is preferable that the opening should be provided at a location to be faced to a surface of the core that is disposed inside the resin member with the fastener being disposed therebetween, that is, between the opening and the surface of the core, and have a depth reaching a surface of the fastener from a surface of the resin member.

According to the present disclosure, it is preferable that the opening should be formed by, when the resin member is molded using a die, a partition wall provided in the die, and the partition wall should abut a surface of the fastener from an opposite side to the core disposed in the die, and prevent the fastener from being deformed by an injection pressure of a resin flowing in between a surface of the core and the fastener.

In one aspect, it is preferable that the resin member should be formed with a protrusion extending in an opposite direction to the core and in parallel with a depthwise direction of the opening, and a part of the resin member should be filled in an interior of the protrusion, a space between a surface of the core and the fastener, and a space between a surface of the fastener and a surface of the resin member.

It is preferable that the opening should have a cross-sectional shape that is parallel to a surface of the fastener, and the cross-sectional shape should include a long axis that is parallel to or substantially parallel to a longitudinal axial line of the fastener, and a short axis that is orthogonal or substantially orthogonal to the longitudinal axial line of the fastener.

It is preferable that the resin member should be provided with a resin fill portion, and the opening should be provided in a portion of the fastener embedded in the resin member and displaced toward the resin fill portion.

A manufacturing method of the reactor employing the above-explained structure is also an aspect of the present disclosure.

According to the present disclosure, the partition wall blocks out the resin flowing in from the resin fill portion, and thus the resin member is provided with an opening exposing a surface of the portion of the fastener embedded in the resin member. No injection pressure is directly applied to the fastener upon molding, thereby suppressing a deformation of the fastener. As a result, when the fastener is fixed to the casing by screw, no stress originating from a deformation at the time of molding is applied between a portion of the fastener embedded in the resin member and a portion protruding therefrom. Therefore, the vibration resistance can be improved.

DETAILED DESCRIPTION

1. First Embodiment

A first embodiment of the present disclosure will be explained in detail with reference to FIGS. 1 to 5.

(1) Structure

Figure 1:
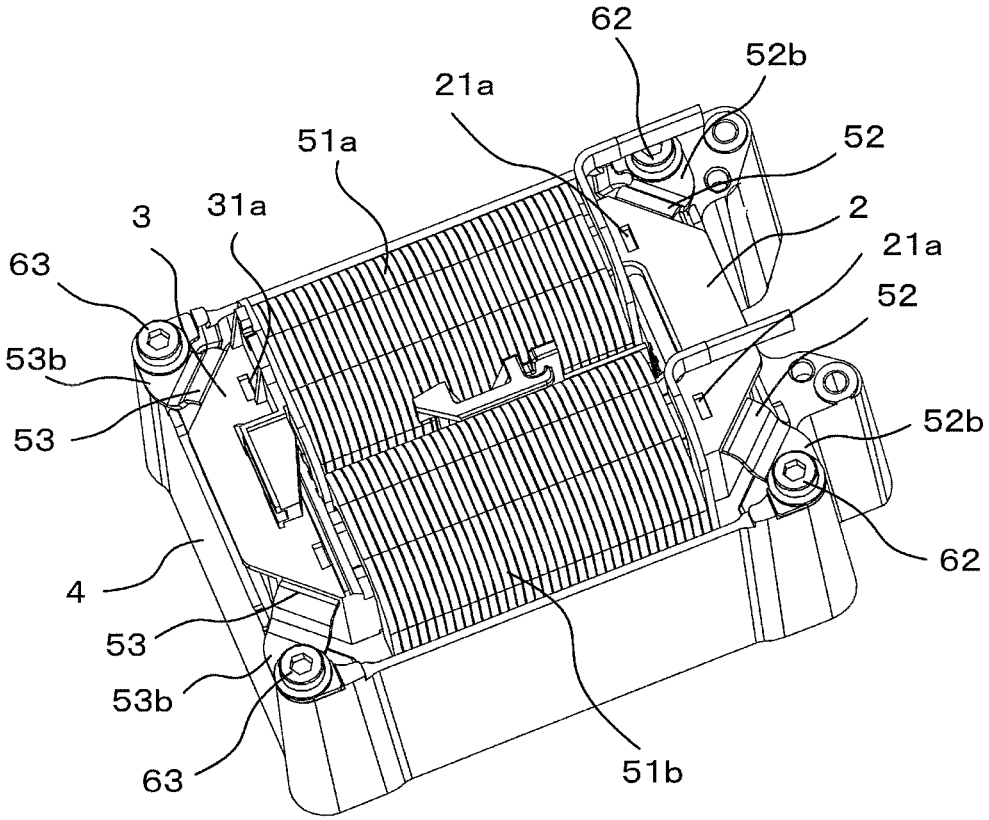
FIG. 1 is a perspective view illustrating a reactor according to a first embodiment.
Figure 2:
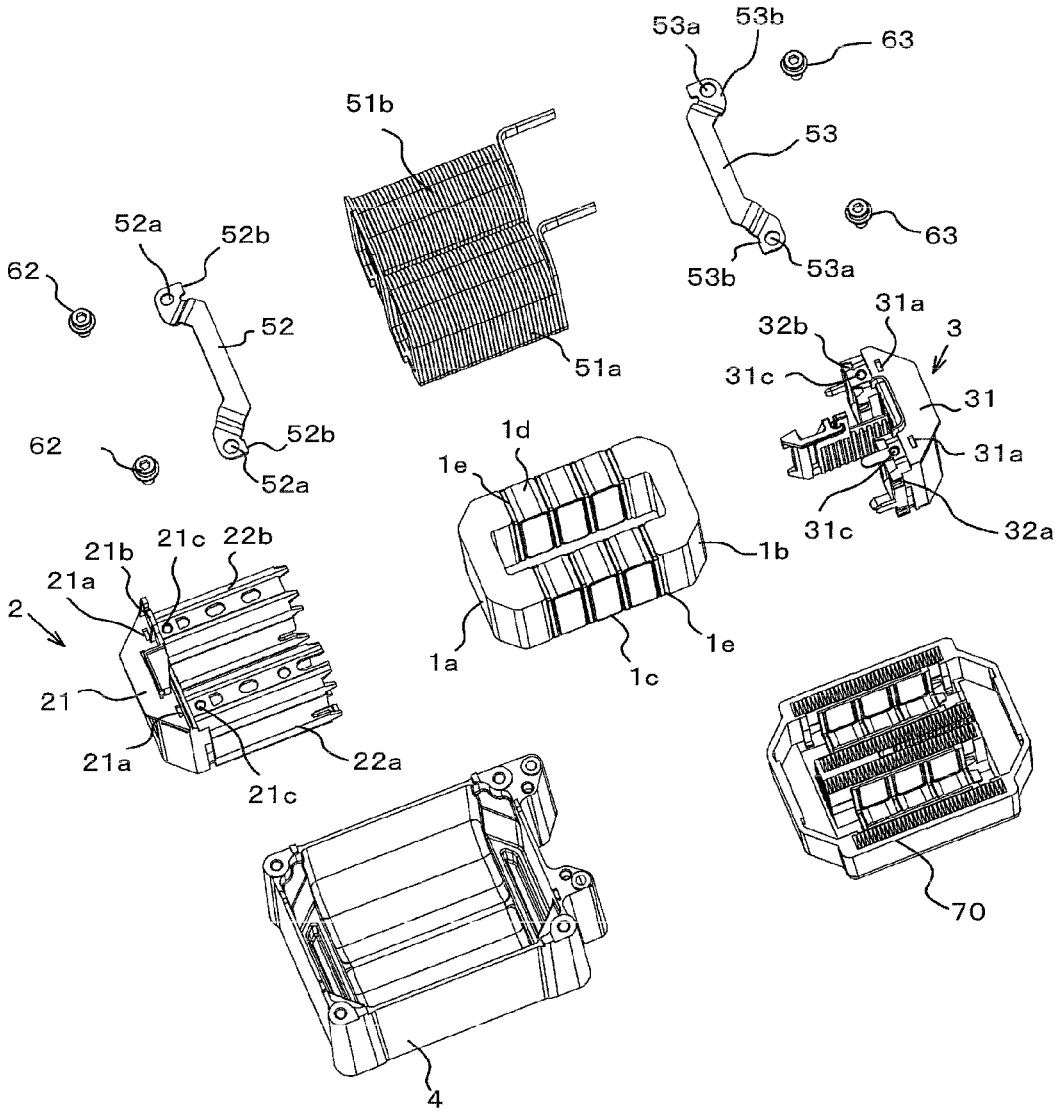
FIG. 2 is an exploded perspective view of the reactor of the first embodiment.

A reactor of this embodiment includes a magnetic annular core having four corners chamfered linearly, and this annular core includes, as is illustrated in the exploded perspective view of FIG. 2, two U-shaped cores 1*a*, 1*b* forming yokes, I-shaped cores 1*c*, 1*d* forming the right and left leg portions. Number of the I-shaped cores is not limited. In this embodiment, three I-shaped cores are provided for each of the right and left leg portions. The U-shaped cores and the I-shaped cores are joined together via spacers 1*e*. The U-shaped cores and the I-shaped cores may be joined directly to each other without intervening spacers.

The annular core is covered by first and second resin members 2, 3 provided around the outer circumference of the annular core. The first resin member 2 includes right and left bobbins 22*a*, 22*b* formed in a cylindrical shape, and a core covering portion 21 provided to connect the two bobbins 22*a*, 22*b* to each other, and the first U-shaped core 1*a* is embedded inside the core covering portion 21 by molding. The second resin member 3 includes right and left bobbins 32*a*, 32*b*, and a core covering portion 31 provided to connect the two bobbins 32*a*, 32*b* to each other, and the second U-shaped core 1*b* is embedded inside the core covering portion 31 by molding.

The right and left bobbins 32*a*, 32*b* of the second resin member are shorter than the bobbins 22*a*, 22*b* of the first resin member. The bobbins 32*a*, 32*b* are respectively connected with the bobbins 22*a*, 22*b* to form long bobbins, and the I-shaped cores 1*c*, 1*d* are fitted inside the long right and left bobbins. Right and left coils 51*a*, 51*b* are wound around the outer circumferences of the long bobbins. The right and left coils 51*a*, 51*b* are formed by a conductor wire, and both ends of the coils are drawn upwardly at the second-resin-member-3 side.

Fasteners 52, 53 are embedded in the upper portions of the covering portions 21, 31 of the first and second resin members 2, 3 by molding. The fasteners 52, 53 respectively fasten those resin members to a casing 4. The fasteners 52, 53 are each a long and thin tabular member having screw insertion holes 52*a*, 53*a* provided at both ends. The center portion of each fastener is embedded in the resin member 2, 3. Bracket portions 52*b*, 53*b* are provided with the screw insertion holes 52*a*, 53*a* respectively at both ends thereof. The bracket portions 52*b*, 53*b* are respectively protruded toward both right and left from the resin member 2, 3.

Upon molding, the brackets 52*b*, 53*b* of the fasteners 52, 53 are held by a die, and disposed above the U-shaped cores 1*a*, 1*b* with predetermined spaces from the upper faces of the cores and in parallel with the upper faces. A resin that forms the resin members 2, 3 are filed in the predetermined spaces. A resin that forms the resin members 2, 3 are filled on the upper faces of the fasteners 52, 53 as similar to the spaces between the respective core surfaces and the respective fasteners, and thus forming the covering portions 21, 31.

A reactor main body is formed by the annular core, the resin members 2, 3 and the right and left coils 51*a*, 51*b* employing the above-explained structure. The reactor main body is retained in the casing 4 in an assembled condition, and screws 62, 63 fitted in the screw insertion holes 52*a*, 53*a* of the fasteners 52, 53 are fastened to respective screw holes in the casing 4. Hence, the resin members 2, 3 are fixed to the casing 4. In this case, the reactor main body is fixed to the casing 4 in such a way that a certain space is maintained between the internal surface of the casing 4 and the outer circumferences of the resin members 2, 3 as well as the coils 51*a*, 51*b*. A sealing resin 70 is filled in that space and is cured, thereby integrating the assembled reactor main body with the casing 4.

Figure 5:
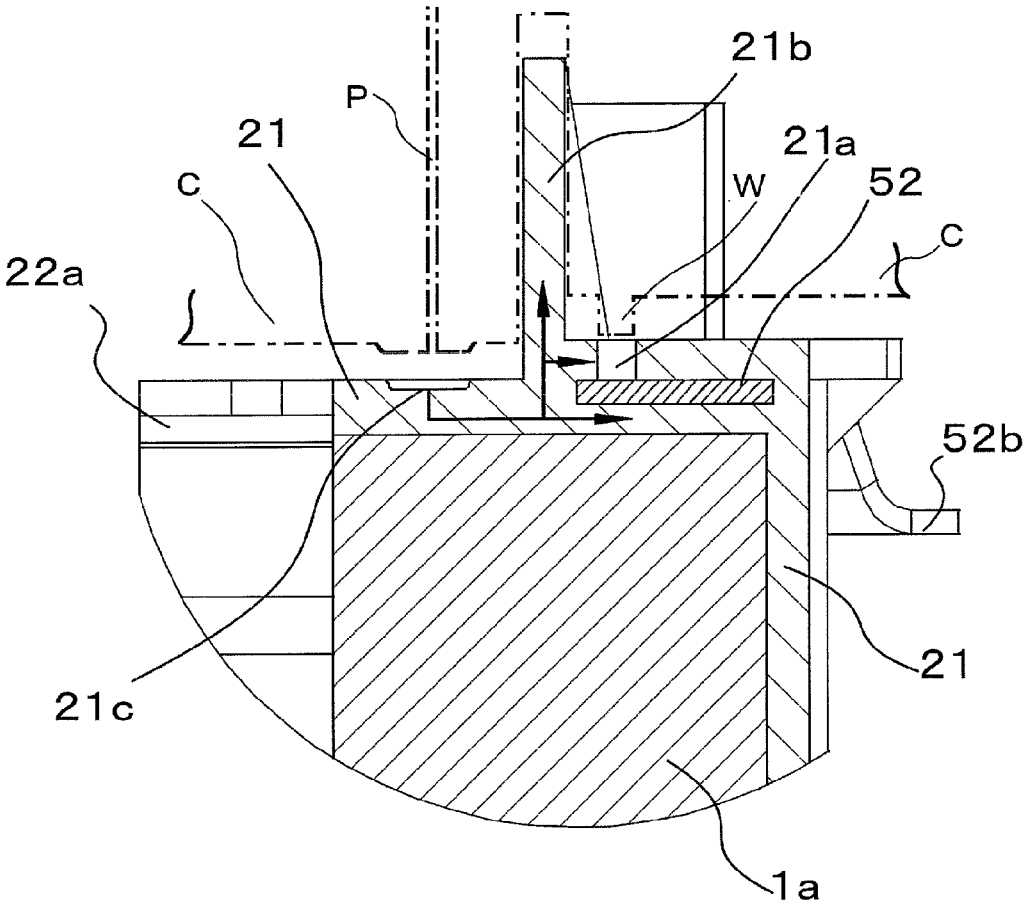
FIG. 5 is a cross-sectional view illustrating a disposition of the fastener, the resin member, and a core in the reactor of the first embodiment.
Figure 6:
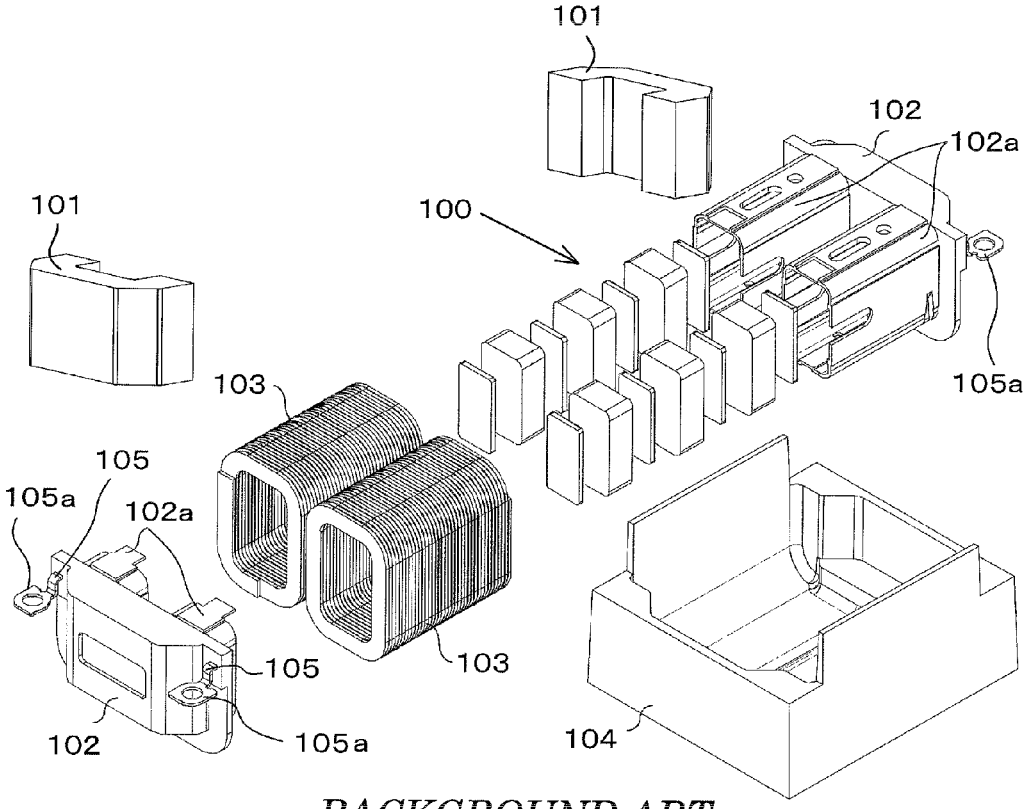
BACKGROUND ART FIG. 6
FIG. 6 is an exploded perspective view illustrating an example conventional reactor.
Figure 7:
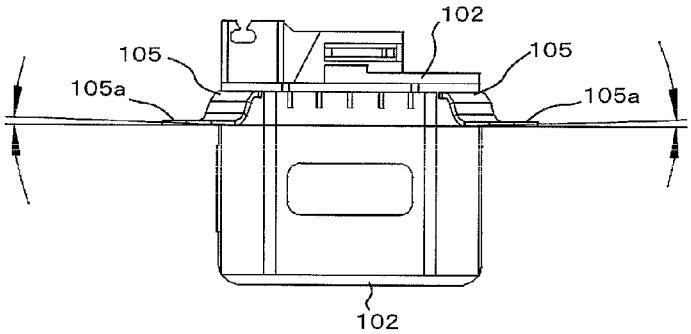
BACKGROUND ART FIG. 7
FIG. 7 is a side view of the conventional reactor having a fastener deformed.

As is illustrated in the cross-sectional view of FIG. 5, the first and second resin members 2, 3 are formed by injecting a resin into a die C through a resin-filling apertures P provided therein and then curing the resin. In this embodiment, the resin-filling apertures P are located at the positions corresponding to the respective centers of the bases of the bobbins 22*a*, 22*b*, 32*a*, 32*b* of the resin members 2, 3.

Figure 3:
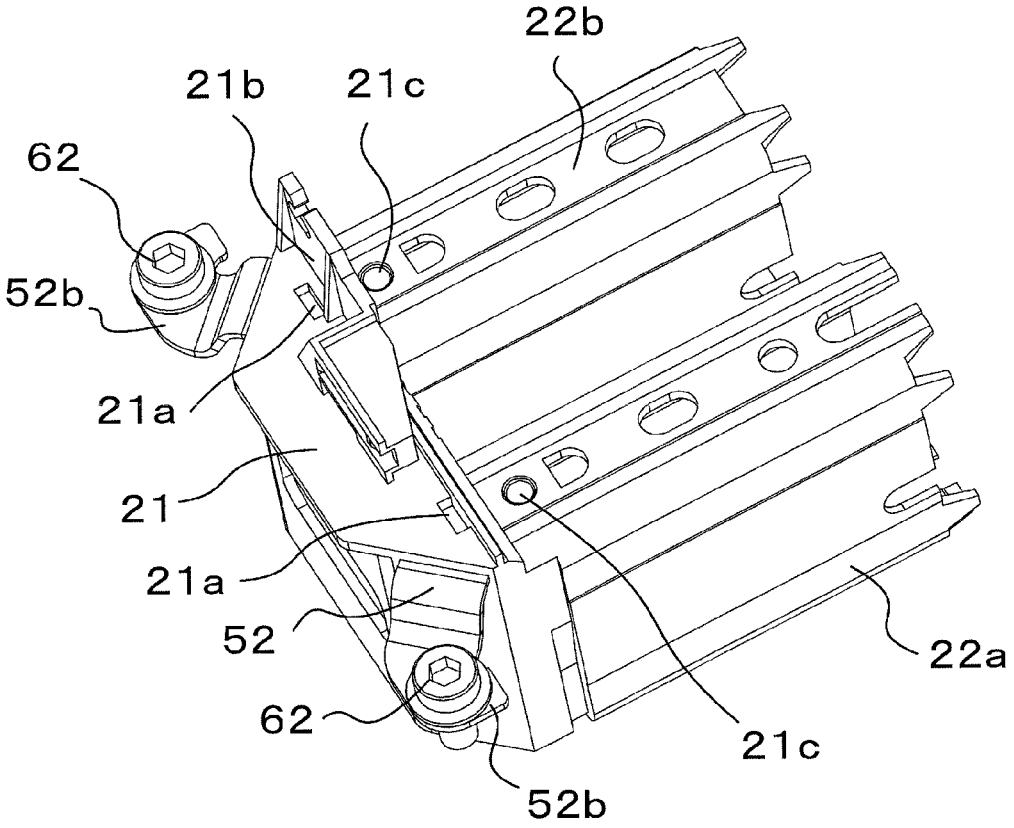
FIG. 3 is a perspective view illustrating a U-shaped core and a resin member in the reactor of the first embodiment as viewed from the front left side.
Figure 4:
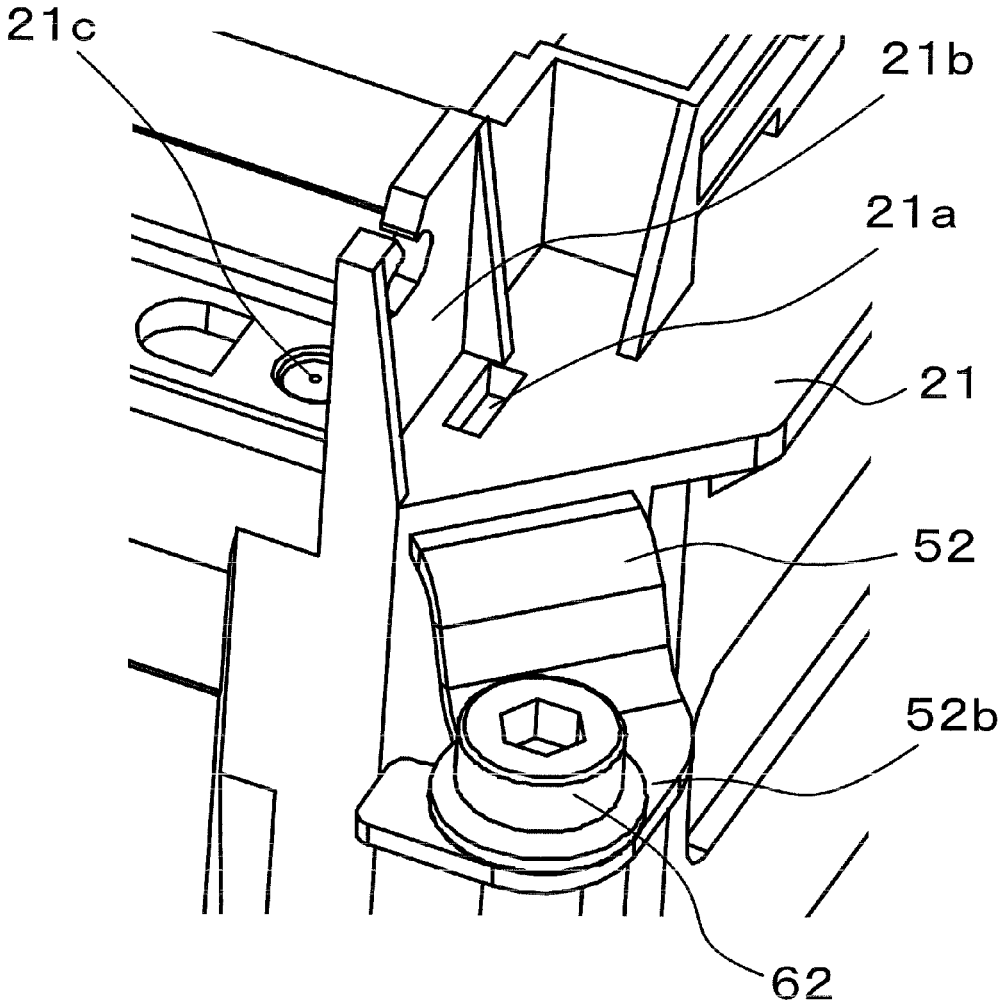
FIG. 4 is an enlarged perspective view illustrating an opening and a resin fill portion provided in a covered portion of the reactor of the first embodiment.

Hence, as illustrated in the perspective view of FIG. 3 and the cross-sectional view of FIG. 5, respectively, the cured resin members 2, 3 are formed with resin-filling portions 21*c*, 31*c* corresponding to the locations of the resin-filling apertures P. In FIGS. 3 and 5, the resin-filling portions 21*c*, 31*c* can be seen as a circular recess, but this circular recess is a head portion of the resin-filling aperture P provided in the die, and the actual resin-filling portions 21*c*, 31*c* are each like a dot portion provided at the center of the circular recess, and is sealed by a filled resin after the molding.

Rectangular openings 21*a*, 31*a* reaching the surfaces of the fasteners 52, 53 from the surfaces of the covering portions 21, 31 are formed above the fasteners 52, 53 in the covering portions 21, 31. The openings 21*a*, 31*a* are rectangular and have a cross-sectional shape that is parallel to the surface of the fastener with a long axial line parallel to the longitudinal axial line of the fastener 52, 53 and a short axial line orthogonal or substantially orthogonal to the axial line of the fastener. The openings 21*a*, 31*a* are formed by a partition wall W of the die C abutting the surfaces of the fasteners 52, 53. The openings 21*a*, 31*a* are located on the respective center axes of the right and left bobbins 22*a*, 22*b*, 32*a*, 32*b*, and at positions displaced toward the bobbins from the centers of the fasteners 52, 53 in the widthwise directions thereof.

The partition wall W that forms the openings 21*a*, 31*a* prevents the injection pressure of the resin flowing from the resin-filling portions 21*c*, 31*c* from being directly applied to the upper faces of the fasteners 52, 53 upon molding the resin members 2, 3. Hence, the openings 21*a*, 31*a* are provided to be vertical to the upper faces of the fasteners 52, 53 and to intersect at the right angle with the flowing direction of the resin between the resin-filling portions 21*c*, 31*c* provided in the resin members 2, 3 and the upper faces of the fasteners 52, 53.

A protrusion 21*b* is formed between the resin-filling portion 21*c* and the opening 21*a* in the first resin member 2. The protrusion 21*b* extends in the opposite direction to the U-shaped core 1*a* and in parallel with the opening 21*a*. This protrusion 21*b* protrudes upwardly from the surface of the covering portion 21, and holds a connector of an unillustrated temperature sensor. By this protrusion 21*b*, the resin poured from the resin-filling portion 21*c* is divided and flow in this protrusion 21*b*, between the upper face of the U-shaped core 1*a* and the fastener 52, and between the surface of the fastener 52 located behind the partition wall W and the internal surface of the die C.

According to this embodiment, the second resin member 3 is not provided with such a protrusion, but a similar protrusion like a reinforcement rib may be provided on the surface of the covering portion 31.

(2) Advantageous Effects (2-1) According to this embodiment, the resin poured from the resin-filling apertures P that are corresponding to the resin-filling portions 21*c*, 31*c*, are blocked out by the partition wall W in the die. Hence, the injection pressure is not directly applied to the upper faces of the fasteners 52, 53, thereby preventing the fasteners 52, 53 from being deformed. As a result, when the fasteners 52, 53 are fastened to the casing 4 by screws, no stress originating from a deformation at the time of molding is applied between the portions of the fasteners embedded in the resin members 2, 3 and the protruding portions thereof from the resin members 2, 3. Therefore, the vibration resistance is improved.

(2-2) According to this embodiment, the brackets 52*b*, 53*b* provided at both ends of the fasteners 52, 53 are supported by the die C upon molding. As a result, the fasteners 52, 53 are disposed above the U-shaped cores 1*a*, 1*b* with predetermined spaces from the respective upper faces of the cores and in parallel with the upper faces of the respective U-shaped cores. The resin is poured and filled in those spaces. Accordingly, although the resin-filling portions 21*c*, 31*c* are provided above the fasteners 52, 53, the resin is blocked out by the partition wall W, and is not likely to flow into the upper-face side of the respective fasteners 52, 53, but is likely to flow into the respective spaces between the fasteners and the U-shaped cores. As a result, the fasteners 52, 53 are supported from the bottom side by the resin flown into the spaces between the fasteners 52, 53 and the U-shaped cores 1*a*, 1*b*, and even if the resin flows around the partition wall W and flows in the upper space of the fasteners, the fasteners 52, 53 are not depressed by such a resin from the upper side, thereby suppressing a deformation of the fastener. In particular, according to this embodiment, the partition wall W forming the openings is located closer to the resin-filling portions 21*c*, 31*c* than the fasteners 52, 53. Hence, application of the injection pressure of the resin to the fasteners 21*c*, 31*c* can be further suppressed.

(2-3) According to this embodiment, upon molding, the partition wall W abuts the surface of the fastener 52, 53 from the opposite side to the U-shaped core. Hence, the fastener can be prevented from deforming toward the partition wall side due to the injection pressure of the resin flown into between the core surface and the fasteners. Accordingly, the positioning of the surfaces of the fasteners 52, 53 can be positioned at the tip end of the partition wall W, and the center portion of the fastener can be leveled at the same angle as the brackets at both ends held by the die. Therefore, a deformation of the fastener can be effectively suppressed.

(2-4) According to this embodiment, the resin filled through the resin-filling portions 21*c*, 31*c* is divided and flow in the protrusion 21*b*, between the upper face of the U-shaped core 1*a*, 1*b* and the fastener 52, 53, and between the surface of the fastener 52, 53 behind the partition wall W and the internal surface of the die C. Hence, in comparison with a structure having no protrusion 21*b*, the injection pressure of the resin can be further dispersed, thereby suppressing a deformation of the fasteners 52, 53 further effectively.

2. Other Embodiments

The present disclosure is not limited to the aforementioned embodiment, and includes other embodiments described below.

(1) According to the aforementioned embodiment, the brackets are provided at both ends of the fastener, but a fastener having a bracket provided at only one end is also applicable. In particular, according to the fastener having the bracket provided at one end, when the bracket portion is held by the die, the end to be embedded in the resin member is not held by the die, and thus the fastener is likely to be deformed by the injection pressure of the resin. According to the present disclosure, however, the partition wall suppresses a direct application of the injection pressure to the fastener, and the tip end of the partition wall holds the tip of the fastener, thereby preventing a deformation of the fastener.

(2) According to the aforementioned embodiment illustrated in the figures, the partition wall contacts the surface of the fastener, and prevents the fastener from being deformed upwardly by the pressure of the flowing resin. When, however, the space below the fastener is small and the flowing pressure is small, it is not always necessary for the partition wall to have the leading end contacting the surface of the fastener.

(3) The cross-sectional shape of the partition wall in parallel with the surface of the fastener is not limited to a rectangular shape, and can be other shapes, such as an oval shape, a rounded-corner rectangular shape, a triangular shape, a dog-leg shape, a chevron shape, or a circular arc shape. The dog-leg shape, the chevron shape, and the circular arc shape divides and guides the resin flow into right and left, and thus the flowing pressure applied to the fastener can be effectively dispersed.

(4) The partition wall W and the openings 21*a*, 31*a* formed by the partition wall W may have a parallel cross-sectional shape to the surface of the fastener having a long axis that is substantially parallel to the longitudinal axial line of the fastener and a short axis that is orthogonal to the longitudinal axial line of the fastener. That is, it is not always necessary that the partition wall and the openings have a right angle relative to the flowing direction of the resin, but may be inclined slightly, and may have a true-circular shape, a square shape, a polygonal shape, or a wavy cross-sectional shape. The number of the partition walls and that of the openings formed by the partition walls are not limited to two, and may be one or equal to or greater than three. Still further, the partition wall is not limited to one perpendicular to the surface of the fastener, and may be inclined relative to the surface of the fastener.

(5) In the aforementioned embodiment, the resin-filling portion is provided above the core in the covering portion of the resin member, but may be provided in the lateral side of the core, or may be provided in the bobbin portion. In addition, when the resin-filling portion is provided above the core, such a portion may be provided at the opposite side of the fastener to the bobbin. It is not impossible to provide the resin-filling portion right above the fastener, but in order to ease the injection pressure of the resin, it is necessary to provide the partition wall in parallel with the surface of the fastener, and an opening parallel to the surface of the fastener is formed in the external side face of the resin member. That is, according to the present disclosure, a space between the fastener and the resin-filling portion means a location on the flow channel of the resin flowing in therebetween, and the location of the resin-filling portion and that of the partition wall are not limited to particular locations as long as the resin flowing in through the resin-filling portion is blocked out by the partition wall forming the openings, and is prevented from directly contacting the fastener.

(6) The location of the fastener can be changed as needed in accordance with the casing to which the reactor main body is fastened, and the position and shape of a screw hole provided in the casing. The fastener may be provided on the side of the U-shaped core or on a bottom face thereof. In this case, the location of the partition wall and those of the resin-filling portions can be changed as needed in accordance with the location of the fastener.

What is claimed is:

1. A reactor comprising:

a reactor main body;

a casing retaining thereinside the reactor main body; and a fastener fixing the reactor main body to the casing, the reactor main body includes a core, a resin member covering around the core, and a coil wound around the resin member;

the fastener includes a portion embedded in the resin member, and a bracket protruding from the resin member, the bracket being fixed to the casing; and the resin member is provided with an opening exposing a surface of the portion of the fastener embedded in the resin member.

2. The reactor according to claim 1, wherein:

the opening is formed by, when the resin member is formed by molding using a die, a partition wall provided in the die; and the partition wall suppresses a direct application of a pressure of a resin to be filled in the die to the fastener.

3. The reactor according to claim 1, wherein:

the fastener is a long and thin tabular member and has the bracket that protrudes from the resin member at each end of the tabular member; and the fastener is disposed in parallel with a surface of the core with a predetermined space present therebetween, and a part of the resin member is filled in the predeteli lined space.

4. The reactor according to claim 1, wherein the opening is provided at a location to be faced to a surface of the core that is disposed inside of the resin member with the fastener being disposed therebetween, and has a depth reaching a surface of the fastener from a surface of the resin member.

5. The reactor according to claim 1, wherein:

the opening is formed by, when the resin member is molded using a die, a partition wall provided in the die; and the partition wall abuts a surface of the fastener from an opposite side to the core disposed in the die, and prevents the fastener from being deformed by an injection pressure of a resin flowing in between a surface of the core and the fastener.

6. The reactor according to claim 1, wherein:

the resin member is formed with a protrusion extending in an opposite direction to the core and in parallel with a depthwise direction of the opening; and a part of the resin member is filled in an interior of the protrusion, a space between a surface of the core and the fastener, and a space between a surface of the fastener and a surface of the resin member.

7. The reactor according to claim 1, wherein:

the opening has a cross-sectional shape that is parallel to a surface of the fastener; and the cross-sectional shape includes a long axis that is parallel to or substantially parallel to a longitudinal axial line of the fastener, and a short axis that is orthogonal or substantially orthogonal to the longitudinal axial line of the fastener.

8. The reactor according to claim 1, wherein:

the resin member is provided with a resin-filling portion; and the opening is provided in a portion of the fastener embedded in the resin member and displaced toward the resin-filling portion.

* * * * *